United States Patent [19]

Oshima et al.

[11] Patent Number: 4,834,247

[45] Date of Patent: May 30, 1989

[54] SEALED CONTAINER FOR USE IN COOKING WITH IMPROVED HEAT-SEAL LINE

[75] Inventors: Yoshiyuki Oshima; Yasunobu Miyoshi, both of Ikoma; Hiroko Hioki, Osaka, all of Japan

[73] Assignee: House Food Industrial Company Limited, Higashiosaka, Japan

[21] Appl. No.: 30,746

[22] Filed: Mar. 27, 1987

[30] Foreign Application Priority Data

Mar. 27, 1986 [JP] Japan ..... 61-68948

[51] Int. Cl.[4] ..... B65D 51/16

[52] U.S. Cl. ..... 206/631; 206/632; 220/359; 220/360; 220/363; 229/2.5 R; 229/48 T; 229/123.1; 383/100; 383/107

[58] Field of Search ..... 206/631, 632, 633; 229/2.5 R, 43, 44 R, 45 R, 48 T, 48 R; 383/107, 108, 35, 94, 100, 103; 220/359, 360, 361, 363, 270

[56] References Cited

U.S. PATENT DOCUMENTS

| | | | |
|---|---|---|---|
| 3,172,768 | 3/1965 | Joosten et al. | 426/123 X |
| 3,510,054 | 5/1970 | Sanni et al. | 206/632 X |
| 3,547,338 | 12/1970 | Hemmes | 206/631 X |
| 3,854,653 | 12/1974 | Engelsberger | 206/633 |
| 3,937,396 | 2/1976 | Schneider | 426/118 X |
| 3,997,677 | 12/1976 | Hirsch et al. | 229/43 X |
| 4,091,930 | 5/1978 | Buchner et al. | 229/43 X |
| 4,203,520 | 5/1980 | Schuster | 383/94 X |
| 4,210,674 | 7/1980 | Mitchell | 426/118 X |
| 4,355,721 | 10/1982 | Knott, II et al. | 229/43 X |
| 4,428,494 | 1/1984 | Hirota et al. | 220/270 |
| 4,456,164 | 6/1984 | Foster et al. | 229/43 |

FOREIGN PATENT DOCUMENTS

| | | | |
|---|---|---|---|
| 0001094 | 3/1979 | European Pat. Off. | 229/43 |

*Primary Examiner*—Stephen Marcus
*Assistant Examiner*—Bryon Gehman
*Attorney, Agent, or Firm*—Oblon, Fisher, Spivak, McClelland & Maier

[57] ABSTRACT

A sealed container for use in cooking which has a heat-sealed portion partially opened when there is an increase in the internal pressure during heat cooking of various kinds of food including frozen foods contained therein so as to prevent rupture or deformation of the container, as well as the possibility of the contents boiling over as a result of rupture of the container. The sealed container of the present invention includes a container body provided at the opening thereof with a flange, and a lid, and a heat-sealed strip capable of peeling off is formed on the flange portion, at least one portion of the heat-sealed strip being formed in such a manner as to project toward the interior of the container, and the outer edge of the heat-sealed strip at that position and an innermost point of the outer edge of the heat-sealed strip being disposed on the inner side of a line connection the starting point of the projecting portion located on the inner edge of the container.

10 Claims, 6 Drawing Sheets

SEALED CONTAINER FOR USE IN COOKING WITH IMPROVED HEAT-SEAL LINE

BACKGROUND OF THE INVENTION (1) Field of the Invention

The present invention relates to a sealed container for use in cooking which has a heat-sealed portion partially opened when there is an increase in the internal pressure during cooking of various kinds of food including frozen foods contained therein so as to prevent rupture or deformation of the container, as well as the possibility of the contents boiling over as a result of rupture of the container.

(2) Prior Art

Various types of sealed containers containing a variety of goods have been placed on the market. All of these sealed containers, however, rupture or become deformed due to increased internal pressure when heated in a microwave oven in the ordinary state, and various techniques for preventing these problems have accordingly been developed. The specification of Japanese Utility Model Publication No. 31590/1984, for example, describes a sealed container in which a lid made of paper or synthetic resin has a slit or small hole therein, is coated on the back thereof with a hot-melt adhesive, and is attached to the opening of a sealed container. In such a container, since the hot-melt adhesive is softened by the heating or the slit or the small hole is opened by the increased internal pressure, it is possible to reduce the pressure, thereby preventing the container from rupturing. In the specification of Japanese Utility Model Un-Examined Publication No. 37402/1976, it is proposed that the internal pressure be reduced by providing a portion of the lid of the container which is thinner than the remaining portion, or by providing the lid with a small hole which is covered by a thin film, these thinly formed portions being broken by any increase in the internal pressure.

All of these methods, however, suffer from the problem that several additional production processes are needed. This makes the production of the container complex and increases the production cost. In a container which employs a hot melt having a low melting point, melted hot melt may contact the food during heating. This is undesirable for reasons of sanitation. Moreover, the thinner portion or slit formed on the lid may be broken during the distribution process.

Heat-sealed containers with a heat-sealed portion having a projecting portion have also been known. Japanese Patent Un-Examined Publication No. 64970/1981 and Japanese Utility Model Un-Examined Publication No. 110266/1985, for example, disclose a heat-sealed container in which the heat-sealed portion has a portion projecting toward the exterior of the container at an acute angle for the purpose of facilitating the opening of the container. Such a container can therefore be easily opened by hand. One objective of all of these containers is to provide for improved removal of the heat-sealed portion when external force is applied. They do not therefore necessarily result in the heat-sealed portion readily peeling off as a natural result of any increase in the internal pressure of the container.

SUMMARY OF THE INVENTION

Accordingly, it is a primary object of the present invention to provide a sealed container suitable for use in cooking food, part of which is automatically opened when any increase in the internal pressure occurs due to expansion of the steam arising from the water content of the food or the air in the container on heating, so as to prevent the container from rupturing or deforming.

The present invention is based on the knowledge that the above-described object can be effectively attained by employing heat-sealing to seal the container and by providing a projecting portion on the heat-sealed strip which protrudes toward the interior of the container in a particular manner.

In accordance with the present invention, there is provided a sealed container for use in cooking which has a heat-sealed strip capable of peeling off, at least one portion of the heat-sealed strip being formed in such a manner as to project toward the interior of the container, the outer edge of the heat-sealed strip at that position and the innermost point of the outer edge of the heat-sealed strip being displaced on the inner side of a line connecting the starting points of the projecting portion located on the inner edge of the heat-sealed strip.

The above and other objects of the invention will be clear from the following description.

DESCRIPTION OF THE PREFERRED EMBODIMENTS

In these FIGS. 2, 15, 45, 55, 65 and 75 designate a heat-sealed belt; 3, 16, 46, 56 and 66 designate a portion which projects toward the interior of the container.

The sealed container of the present invention may be formed into a container which comprises a container body for containing any of various kinds of food, and a lid for covering an upper opening of the container body, wherein the contacting surfaces of the container body and the lid are heat-sealed to provide for sealing of the container. The sealed container of the present invention may also be in the form of a bag in which two ends of a cylindrical bag are heat-sealed.

The container body of the container of the present invention may be a rectangular parallelopiped, a cube or a cylinder in shape. The upper portion of the container may be fully opened to form an upper opening, or an upper opening may be formed by opening part of the upper portion of the container. The container body may be double-skinned or multi-skinned. The container body can be formed into any shape, so long as a food may be contained therein. The lid may be formed into a sheet or a cube.

The container body and the lid may be formed of any water-resistant material having normal strength capable of containing the contents. The material of either the container body or the lid, however, must be thermal adhesive. The container body and the lid may, for example, be formed of metal, composite paper or various types of plastics. If both are made of metal, however, a thermal adhesive sealant must be laminated on either the containr or the lid. A heat resistant material (one which does not melt at a temperature of 100° C.) which transmits microwaves and withstands heating in a microwave oven may be employed as the material of the container body and the lid, if the container is of a type for containing food to be cooked in a microwave oven. Suitable materials of this type include polyethylene, polypropylene, polycarbonate, polyester, polyphenylene oxide, polysulfone, nylon, and paper coated with any of the above polymers. preferably, the container body may be formed of polypropylene (PP), blended material of PP and polyethylene (PE), foamed PP, or a sheet of foamed polystyrene laminated with polyester on the surface thereof, while the material of the sealant provided on the lid may be a sheet or a film of ethylene-vinyl acetate copolymer (EVA), a blended material of PP and PE or a blended material of ethylene-propylene copolymer and PE. If PET is employed as a base film of the lid, it is desirable to laminate it with EVA.

The heat-sealing employed in the container of the present invention will hereinafter be described in some detail by referring to FIG. 2.

Figure 2:
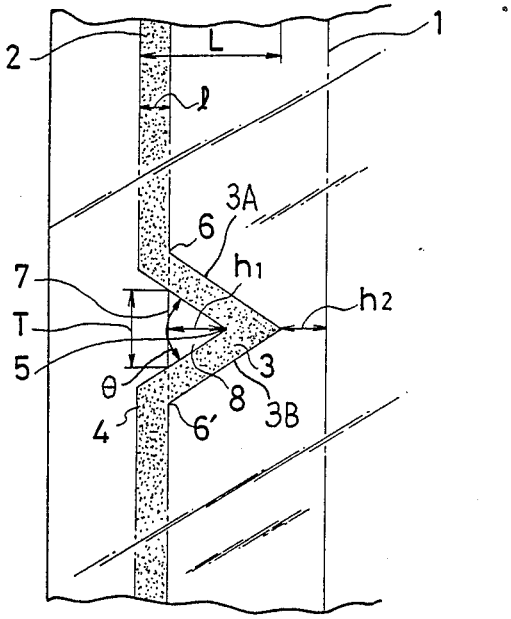
FIG. 2 is an enlarged view of a portion A of the container of FIG. 1.

FIG. 2 shows a joined portion of the container body and the lid, which is formed into a flange portion 1 that extends sideways from the opening of the container body. The heat-sealed strip 2 formed on this joined portion has a protruding or projecting portion 3 which projects in a direction toward the interior of the container at the position 5 and includes legs 3A, 3B forming angle $\theta$ therebetween. The projecting portion 3 is formed such that the outer edge 4 of the heat-sealed strip at the position 5 is disposed on the inner side of a line 7 connecting the starting points 6 and 6' of the protruding portion which are located on the inner edge of the heat-sealed strip. The heat-sealing strength of the heat-sealed portion may be set between 0.1 and 5 kg/15 mm, preferably, between 0.5 and 2.5 kg/15 mm. The width of the heat-sealed portion may be set between 1 and 10 mm, preferably, between 2 and 5 mm. The distance h1 between the distal end 5 of the outer edge of the heat-sealed portion and the line 7 may be set at a value between 0.5 and 5 mm. It is preferable for the distance h2 between the distal end of the inner edge of the heat-sealed protruding portion and the inner edge of the flange to be set between 1.5 and 3 mm, since the distance h2 enables any divergence from this dimension generated in the production process to be absorbed. Length T shown in the figure may be set between 1 and 5 mm. This allows the container to readily open automatically during heating so as to effect steaming of the contents.

In the container of the present invention, a portion 8 defined by the line 7 and the outer edge of the heat-sealed portion need not be heat-sealed. Alternatively, however, it may be heat-sealed with a heat-sealing strength which is less than 90% of that of the heat-sealed strip 2.

The angle $\theta$ between legs 3A, 3B may be set anywhere between 5 degrees and 150 degrees, since an angle of less than 5 degrees makes it difficult to retain the non-heat-sealed portion during heat-sealing, and the length of the protruding portion becomes long. This makes the flange portion uneconomically wide. It also makes the protruding portion likely to peel off too readily during distribution of the product or during sterilization of the contents of heating. On the other hand, an angle exceeding 150 degrees increases the strength of the joint of the protruding portion. This makes it difficult to initially open the container when the internal pressure of the container increases. As a result, the container does not readily open automatically during heat cooking. It is more preferable for the angle of the protruding portion to be between 30 and 110 degrees. An angle set within this range can prevent the protruding portion from peeling off during distribution or storage or during sterilization by heating, and the sealing of the container can therefore be maintained. Such an angle also improves the ease of initial opening of the protruding portion, and this causes the protruding portion to readily peel off due to any increased internal pressure generated when the container is heated.

Figure 7:
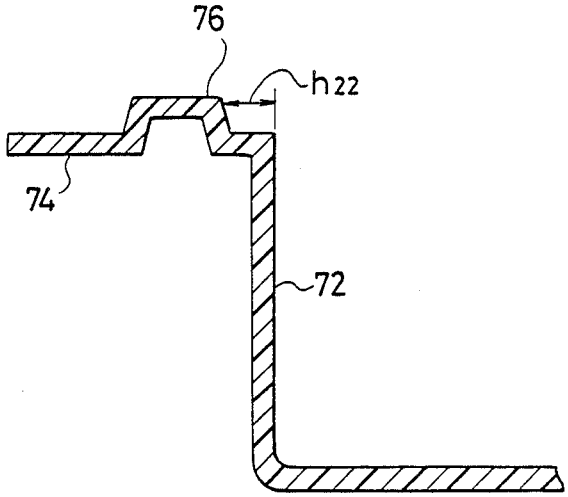
FIG. 7 is a cross-sectional view of a portion of the container body.

As shown in FIG. 7, a container body 72 may alternatively be formed in the state wherein a heat-sealed strip 76 is made to protrude from a flange portion 74. In this way, dimensional divergences which may occur in the production process can be eliminated, and it is therefore not necessary to set a distance h22 from the viewpoint of guarding against dimensional divergence in the production process. A heat-sealed strip may also be formed on the entirety of a flange which itself forms a protruding portion.

The protruding portion of the heat-sealed strip provided on the container according to the present invention may be shaped in the form shown in FIG. 2. However, its form is not limited to the one shown and may be of any form so long as it protrudes toward the interior of the container. Further, a plurality of protruding portions may be provided. The number of protruding portions may, for example, amount to between 2 and 10 when the contents are any of various types of frozen foods having a high water content such as frozen soup. Thus, the internal pressure which increases to a great extent during heating of such food may be suitably dispersed, thereby preventing the heat-sealed portion from peeling off from the opening formed at the protruding portion. An even number of protruding portions may also be provided at mutually opposing positions. This provides for uniform steaming of the contents.

In the container of the present invention, a plurality of heat-sealed strips may be provided. This enables the sealing of the container to be maintained during distribution, and allows the container to readily peel off after cooking.

In the present invention, it is essential to provide the heat-sealed portion with a protruding portion which protrudes toward the interior of the container such that the outer edge of the heat-sealed portion at that position or the innermost point of the outer edge is disposed on the inner side of a line connecting the starting points of the protruding portion located toward the interior of the container. More specifically, since the peeling caused by an increased internal pressure generally stops near the line 7 shown in FIG. 2, it is necessary that the distal end 5 of the protruding portion be on the inner side of the line connecting the starting points 6 and 6' of the protruding portion which are located on the inner edge of the heat-sealed portion, thereby to cause a small hole having a width T to open during cooking.

The heat-sealing employed in the present invention can be performed by any of the known methods.

The container of the present invention has the following advantages:

(i) When the container is heated in a microwave oven, it is partially opened through an opening in the protruding portion of the heat-sealed portion due to the increased internal pressure, and this can prevent the container from rupturing or deforming, as well as prevent the contents from boiling over as a result of rupture of the container.

(ii) The container can be maintained in a sealed state during its distribution and storage period, as well as at the time of sterilization of the container by heating.

(iii) The contents of the container are cooked with the container partially opened. This allows steaming of the contents to be effected.

(iv) Production of the container is facilitated compared with the known automatically opening container, and the production cost can thus be reduced. Automatic opening during heating is suitably effected, thereby enabling sterilization of the container by heating.

Thus, the sealed container of the present invention can be widely used as a container for heat cooking that may contain any of various kinds of food including frozen soup, cooked and frozen food and so on. The sealed container of the present invention is also suitable as a container for retort food, since it can be maintained in a sealed state during heat sterilization such as sterilization by retort.

The present invention will be hereinunder described in detail by examples, which are not given to limit the scope of the present invention.

EXAMPLE 1

Figure 1:
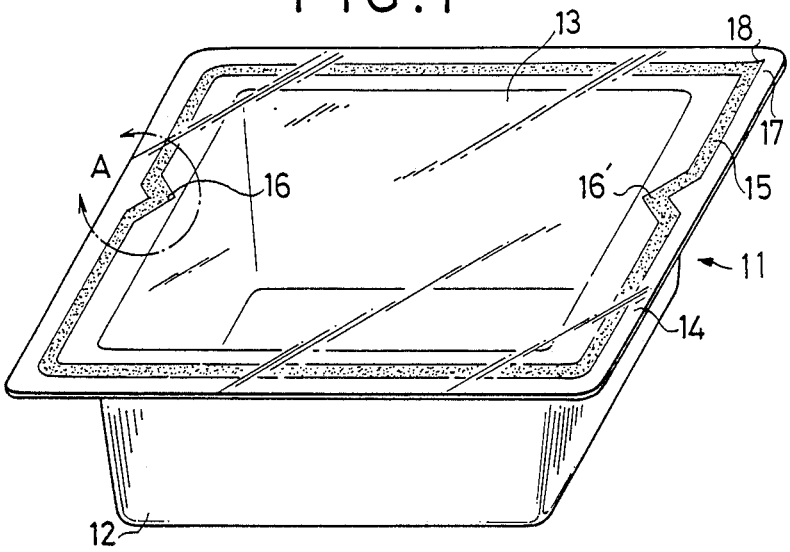
FIG. 1 is a perspective view of an embodiment of a container suitable for use in cooking according to the present invention.

FIG. 1 shows a sealed container 11 for use in heat cooking according to the present invention. The container 11 comprises a container body 12 and a lid 13 which are made to contact each other at a flange 14 formed at the upper opening of the container body 12 at which a heat seal 15 is effected. The heat-sealed strip has protruding portions 16 and 16' formed in such a manner as to protrude toward the interior of the container 11.

The container body 12 is formed of polypropylene having a thickness of 0.5 mm. The lid 13 is made of a polyester/polyethylene/ethylene-vinyl acetate copolymer film which has a thickness of 0.065 mm. A heat seal is provided at the flange portion 14 having a width of 10 mm, by a known method.

The heat-sealed strip has a protruding portion 18 formed at a corner of the container body which protrudes in the opposite direction from that in which the protruding portions 16 and 16' protrude, thereby to facilitate the peeling-off of the lid of the container after cooking.

The protruding portions 16 and 16' are formed, as shown in FIG. 2 on an enlarged scale, such that the width l of the heat-sealed strip 2 is 2 mm, the length L between the outer edge of the heat-sealed portion and the distal end of the protruding portion 3 of the heat-sealed strip is 5 mm, and T, h1 and h2 are 2 mm, 1 mm and 2 mm, respectively.

EXAMPLE 2

Figure 3:
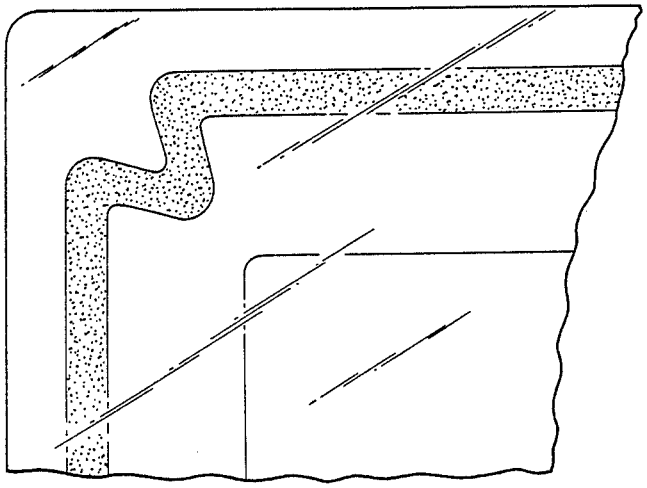
FIG. 3 shows a projecting portion formed at the corner of a container.

A container is provided which is the same as that obtained in Example 2 except that the heat-sealed strip has four inwardly protruding portions at the corners of the flange portion of the container body, as shown in FIG. 3.

EXAMPLE 3

Figure 4:
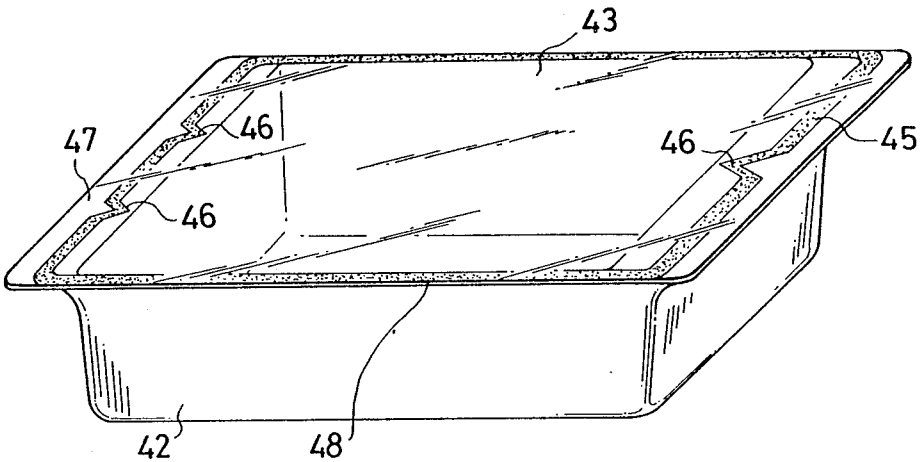
FIG. 4 is a perspective view of another embodiment of the container for cooking according to the present invention.

FIG. 4 shows a rectangular parallelopiped container in which the width of the flange portion at the short sides is made broader. The container body 42 is formed of a polypropylene/EVAL/polypropylene film which has a thickness of 0.7 mm. The sheet that forms the lid 43 is a nylon/polypropylene film having a thickness of 0.09 mm. The heat-sealed strip 45 has a width of 4 mm, and three protruding portions 46 are formed thereon. The width of the flange 47 at the short sides is made to be 15 mm, while that of the flange 48 at the long sides is 6 mm.

EXAMPLE 4

Figure 5:
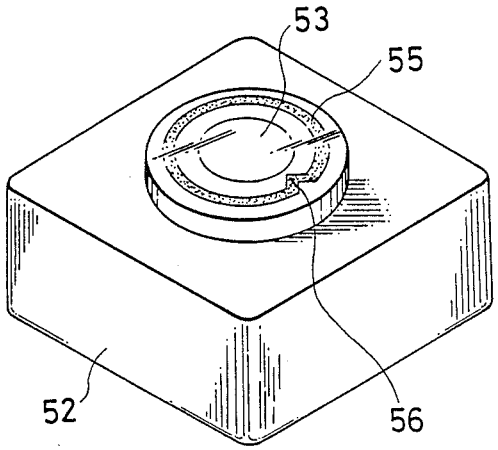
FIG. 5 is a perspective view of still another embodiment of the container for cooking according to the present invention.

FIG. 5 shows a container which includes a container body having a circular opening at the upper portion thereof, and a lid heat-sealed on the opening. A container body 52 is formed of a polypropylene film of 1.5 mm. A lid 53 is a polyester/polyethylene/ethylene-vinyl acetate copolymer sheet of 0.065 mm. Heat-sealing is provided on the contacting portion of the lid 53 and the container body 52, and it has a protruding portion 56 which projects toward the interior of the container.

EXAMPLE 5

Figure 6:
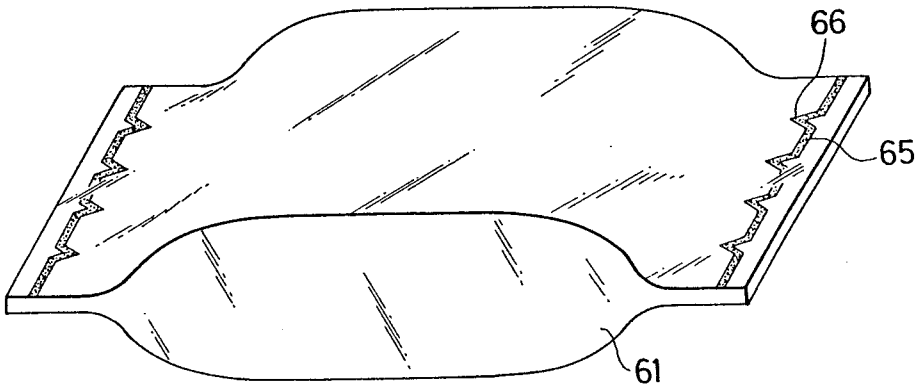
FIG. 6 is a perspective view of still another embodiment of the container for cooking according to the present invention.

FIG. 6 shows a bag-shaped container. A container 61 is formed of a polyester/nylon/polyethylene film. Heat-seal 65 is provided at two ends of the bag, and it has eight inwardly projecting portions.

What is claimed is:

1. A sealed container for use in cooking including a heat-sealed dimensional peelable strip, a first portion of said heat-sealed strip extending linearly and substantially parallel to an edge portion of said container and a second portion projecting in a direction toward a central portion of the container so as to form a substantially V-shaped inwardly projecting portion, and the innermost point of the outer edge of the heat-sealed strip at the projecting portion being disposed on the inner side of a line connecting the starting points of said projecting portion located on the inner edge of the heat-sealed strip wherein the heat-sealing strength of the heat-sealed strip is between 0.1 and 5 kg/15 mm.

2. A sealed container according to claim 1, wherein the container comprises a container body provided at the opening thereof with a flange, and a lid, and the heat-sealed strip is formed on said flange portion.

3. A sealed container according to claim 2, wherein at least one of the container body and the lid is formed of a thermal adhesive material.

4. A sealed container according to claim 2, wherein the container body and the lid are formed of a heat resistant material capable of transmitting microwaves.

5. A sealed container according to claim 2, wherein a sealant is laminated on either the container body or the lid.

6. A sealed container according to claim 1, wherein the width of the heat-sealed strip is from 1 to 10 mm.

7. A sealed container according to claim 2, wherein the distance between the distal end of the inner edge of the heat-sealed projecting portion of the strip and the inner edge of the flange is from 1.5 to 3 mm.

8. A sealed container according to claim 1, wherein two to ten projecting portions are provided in the heat-sealed strip.

9. A sealed container according to claim 1, wherein the container is a bag-shaped container formed by heat-sealing a cylindrical bag.

10. A sealed container according to claim 1, wherein the angle of the projection portion of the strip is from 30 to 110 degrees.

* * * * *